US007222802B2

(12) United States Patent
Sweeton

(10) Patent No.: US 7,222,802 B2
(45) Date of Patent: May 29, 2007

(54) DUAL SPRAYER WITH EXTERNAL MIXING CHAMBER

(75) Inventor: Steve L. Sweeton, Lake Winnebago, MO (US)

(73) Assignee: MeadWestvaco Corporation, Glen Allen, VA (US)

( * ) Notice: Subject to any disclaimer, the term of this patent is extended or adjusted under 35 U.S.C. 154(b) by 0 days.

(21) Appl. No.: 10/833,953

(22) Filed: Apr. 28, 2004

(65) Prior Publication Data

US 2004/0256490 A1 Dec. 23, 2004

Related U.S. Application Data

(60) Provisional application No. 60/472,717, filed on May 23, 2003.

(51) Int. Cl.
*A62C 13/62* (2006.01)

(52) U.S. Cl. ..... 239/304; 239/333; 239/343; 239/399; 239/414; 239/419; 239/433; 239/491; 222/135; 222/383.1

(58) Field of Classification Search ..... 239/399, 239/303, 304, 333, 353, 407, 414, 419, 433, 239/343, 491–494, 590, 590.5, DIG. 23; 222/383.1, 135, 136, 145.5, 129
See application file for complete search history.

(56) References Cited

U.S. PATENT DOCUMENTS

| | | | | |
|---|---|---|---|---|
| 4,779,803 | A | 10/1988 | Corsette | |
| 5,169,029 | A * | 12/1992 | Behar et al. | 222/1 |
| 5,535,950 | A * | 7/1996 | Barriac et al. | 239/304 |
| 5,540,389 | A | 7/1996 | Knickerbocker | |
| 5,560,545 | A | 10/1996 | Grogan et al. | |
| 5,562,250 | A | 10/1996 | O'Neill | |
| 5,647,539 | A | 7/1997 | Dobbs et al. | |
| 5,702,058 | A * | 12/1997 | Dobbs et al. | 239/343 |
| 5,857,591 | A * | 1/1999 | Bachand | 222/1 |
| 5,887,761 | A * | 3/1999 | Foster et al. | 239/304 |
| 6,021,961 | A * | 2/2000 | Brown | 239/398 |
| 6,550,694 | B1 | 4/2003 | Foster et al. | |
| 6,641,003 | B1 | 11/2003 | Foster et al. | |
| 2003/0201339 | A1 | 10/2003 | Foster et al. | |
| 2003/0201342 | A1 * | 10/2003 | Foster et al. | 239/526 |

* cited by examiner

*Primary Examiner*—Steven J. Ganey
(74) *Attorney, Agent, or Firm*—Gordon & Jacobson, PC

(57) ABSTRACT

A dual sprayer has an externally mounted mixing manifold for intimately commingling disparate liquids sprayed during pumping and issuing through a nozzle as a complete admixture of dual liquids.

18 Claims, 2 Drawing Sheets

DUAL SPRAYER WITH EXTERNAL MIXING CHAMBER

BACKGROUND OF THE INVENTION

This invention relates generally to a manually operated dual trigger sprayer, and more particularly to such a sprayer having an externally mounted mixing manifold for combining separate liquids issuing from the sprayer upon sprayer actuation.

Dual trigger sprayers are known having a pair of side-by-side pistons operating in side-by-side pump cylinders for simultaneously drawing liquids separately stored and discharging the liquids through separate discharge passages issuing as separate sprays from the sprayer assembly for intermingling at or on the target. Examples of such sprayers can be found in U.S. Pat. No. 5,857,591, FIG. 6, and in U.S. Pat. No. 5,535,950, FIG. 10. Otherwise, the dual liquids are combined internally of the sprayer assembly at or upstream of the sprayer nozzle for commingling in a spin chamber or the like prior to discharge as a combined spray through a single discharge orifice in the nozzle. Examples of such sprayers can be found in the U.S. Pat. No. 5,857,591 patent, FIG. 10, in the U.S. Pat. No. 5,535,950 patent, FIG. 9, and in U.S. Pat. No. 6,550,694.

It has been found that commingling of disparate sprays at or on the target may be ineffectual as the outer fines of each spray become airborne before they can possibly be entrained into the center. This is due to the outer edge of each spray cone having the highest velocity compared to the velocities of the spray particles nearer the center. This, therefore, results in incomplete mixing of the dual spray liquids which is undesirable and could be harmful depending on the chemical nature of the sprays combined.

BRIEF DESCRIPTION OF THE INVENTION

It is therefore an object of the present invention to provide a dual sprayer having an external mixing manifold to assure intimate commingling of spray particles of separate liquids issuing through separate discharge orifices each provided with its own spin mechanics assembly. The mixing manifold may be in the form of an external attachment mounted at the downstream end of a nozzle cap containing a pair of discharge orifices for the separately issuing liquids. The manifold has a single discharge port through which the combined liquids issue as a spray, stream or foam. The manifold may define a smooth-walled mixing chamber so arranged relative to the discharge orifices that the spray particles impact against the smooth walls causing spray particles of both liquids to intimately commingle before issuing as a combined spray or stream from a discharge port of the adaptor. For foaming, an air aspiration opening may be defined by the attachment permitting ingested air to mix with the commingling separate sprays so as to issue through the discharge port of the attachment as a foam. A foaming screen may be provided at the discharge port for foaming. And, an external guide tube or ring on the attachment at its discharge port can be provided for directing the spray or foam to a selected area of a target. Swirl vanes may be provided on the inner wall of such a tube or ring to even further enhance a commingling of the two separately issuing liquids. And, the external mixing chamber may include some type of baffled geometry such as ribs, vanes, bumps, grooves, a rough surface finish, etc., to enhance turbulence in the mixing chamber to provide for a more intimate combining of the dual liquids before issuing through the attachment nozzle.

Other objects, advantages and novel features of the invention will become more apparent from the following detailed description of the invention when taken together with the accompanying drawings.

DETAILED DESCRIPTION OF THE INVENTION

Figure 1:
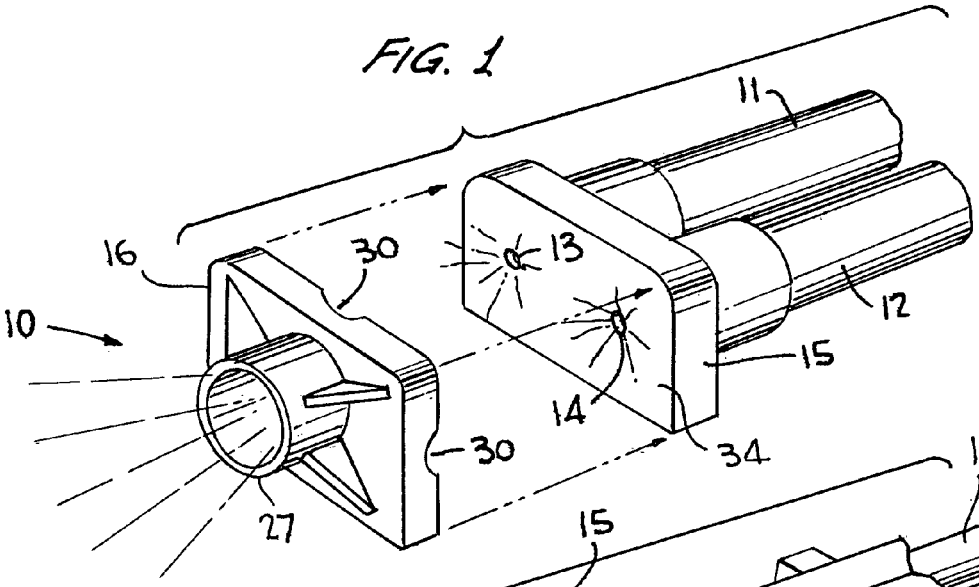
FIG. 1 is an expanded, perspective view illustrating the essence of the invention.
Figure 2:
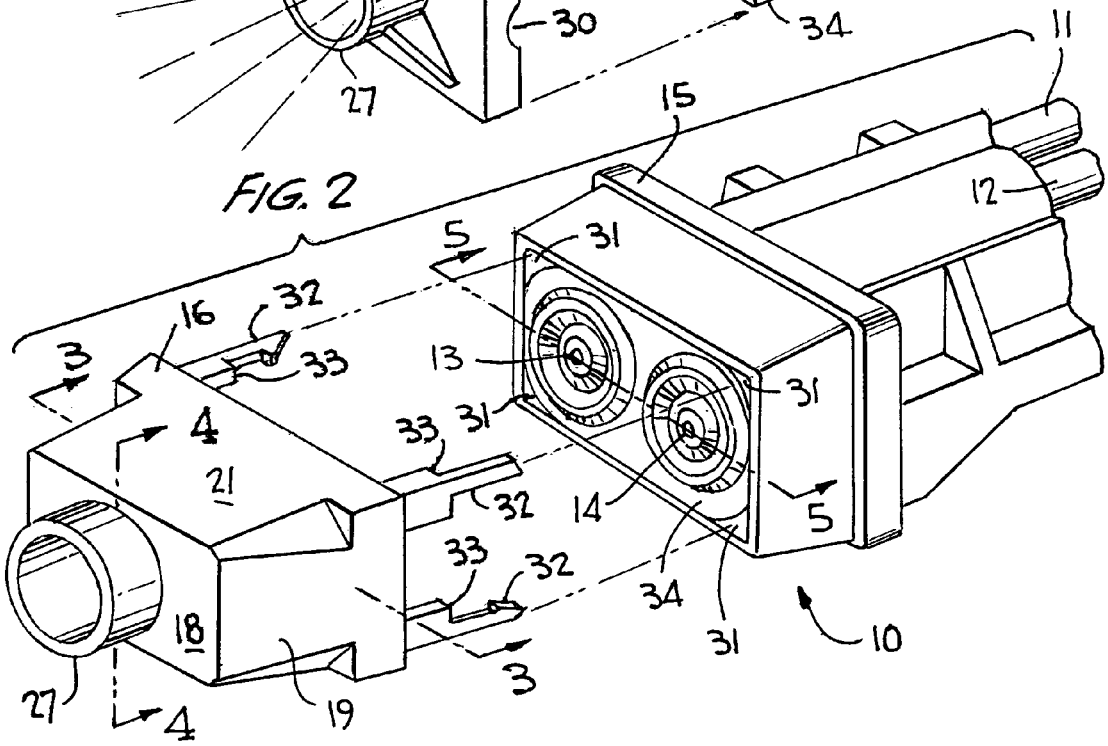
FIG. 2 is an expanded perspective view showing various details of the invention not found in FIG. 1.
Figure 6:
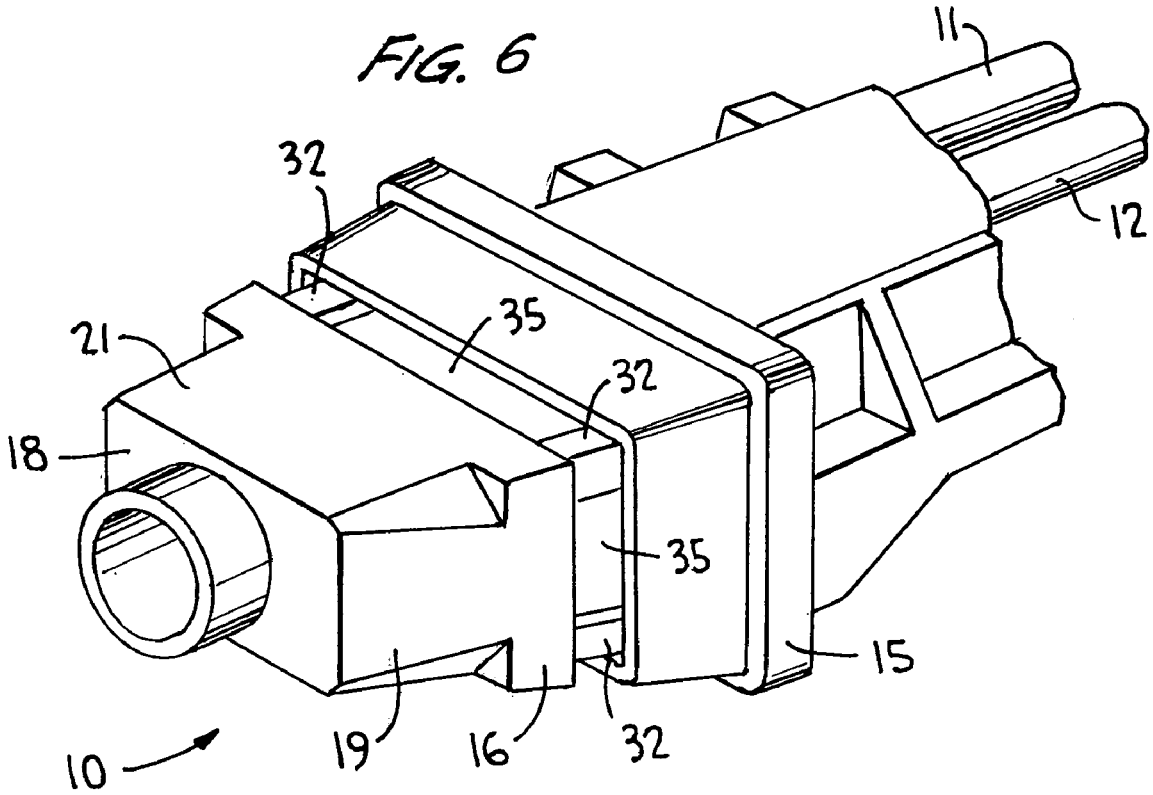
FIG. 6 is a view similar to FIG. 2 showing the external mixing manifold mounted to the spray nozzle of the sprayer.

Turning now to the drawings wherein like reference characters refer to like and corresponding parts throughout the several views, the dual piston trigger sprayer according to the invention, generally designated 10 and partially shown in FIGS. 1, 2 and 6, is part of a dual sprayer as fully shown in U.S. Pat. No. 5,535,590 , commonly owned herewith, and the entirety of the disclosure of which being specifically incorporated herein by reference. Thus, the dual sprayer comprises the side-by-side pump units simultaneously actuated by a single trigger lever for suctioning first and second liquids separately stored into the pump chambers of the pumping mechanisms and discharging the separate liquids through separate side-by-side discharge barrels for issuance as separate sprays to a separate spin mechanics assemblies as shown in FIG. 10 of the U.S. Pat. No. 5,535,950 patent. The dual sprayer of the invention, prior to mixing, is essentially the same in function and operation as that disclosed in the '950 patent. Thus, in the invention, a pump body or housing of the dual dispenser has a dual pump which includes a pair of side-by-side pump pistons respectively reciprocable in a pair of side-by-side pump cylinders configured so that reciprocation of the pistons draw disparate liquids from the liquid compartments into the pump chambers and discharges the liquids through separate discharge passages defined by discharge barrels 11 and 12. The discharge barrels terminate in a common discharge nozzle, or in separate discharge nozzles, although not shown here. Spin mechanics assemblies are associated with each barrel such that the disparate liquids are separately swirled and are discharged through a pair of discharge orifices 13 and 14 respectively associated with the two discharge barrels, in a manner well known in the art. The liquids issue as spray cones which mix and are combined downstream of nozzle cap 15 which contains the discharge orifices and portions of the respective spin mechanics assemblies.

Figure 3:
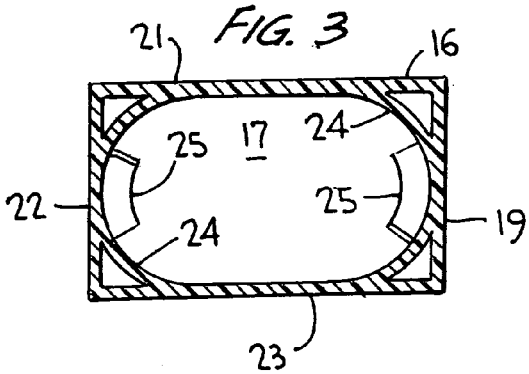
FIG. 3 is a sectional view taken substantially along the line 3—3 of FIG. 2.
Figure 4:
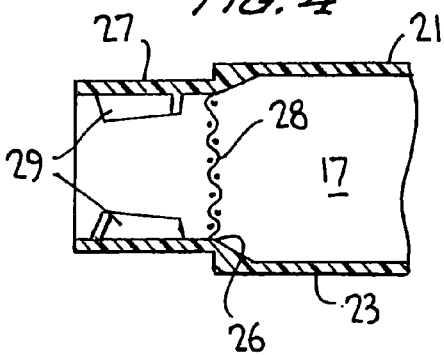
FIG. 4 is a sectional view taken substantially along the line 4—4 of FIG. 2.

An externally mounted mixing manifold having a single discharge port is provided according to the invention to ensure intimate intermingling of spray particles of the disparate liquids so as to be delivered to the target as a thoroughly admixed dual liquid. An attachment 16 open at its upstream end defines a mixing chamber or manifold 17 by its five interconnected walls 18, 19, 21, 22, 23 (FIGS. 2 to 4). The interior of the mixing chamber may be smooth walled and corner rounded as at 24 to avoid the formation of entrapped eddies at the internal corners formed during bombardment of the swirling sprays against the smooth walls for admixing. Otherwise, opposing walls 19, 22, for example, may be provided with suitable arcuate vanes 25 or the like within the interior of mixing chamber 17 to enhance turbulent flow so that the conical spray plumes of disparate liquids issuing from their respective discharge orifices 13 and 14 are induced to swirl in unison in a common direction or in opposing directions, depending on the direction of the vanes. The particles of each of the sprays, from their outer peripheries to their centers, thoroughly and intimately intermingle externally to the dual sprayer. Attachment 16 is shown in FIG. 6 mounted to the front face 34 of nozzle 15, in its operative position.

Front wall 18 of the attachment has a central discharge port 26 (FIG. 4) surrounded by an external nozzle 27 which may be in the form of a collar or the like. The admixed liquids issue from mixing chamber 17 through discharge port 26 and nozzle 27 to the intended target. To effect foaming, with one or both of the liquids containing a foaming agent, a fine mesh screen 28 (FIG. 4) may be provided spanning discharge port 26 to enhance foaming at the time of discharge, in a manner known in the art. Also, with or without the mesh screen, mostly during the former, it may be desirable to further swirl the admixed liquids to increase the forward and spinning velocities thereof by the provision of swirl vanes 29 on the inner wall of nozzle 27 acting in a common direction. Otherwise, vanes 29 acting in opposing directions would further enhance turbulence of the mixture before exiting the nozzle.

Nozzle cap 15 may be provided with corner openings 31 (FIG. 2) for the reception of mounting legs 32 extending in an upstream direction from the four corners of attachment 16. The mounting legs may have shoulders 33 such that in the FIG. 6 mounted position of the attachment, the legs are snapped into openings 31 and their shoulders 33 bear against front face 34 of the nozzle cap so as to maintain gaps 35 between the legs in the fully mounted position. The gaps define air aspiration openings through which ambient air is ingested during operation of the dual sprayer as the disparate liquids issue from their discharge orifices 13 and 14 into the mixing manifold. The ingested air aerates the mixture and, if one or more of the disparate liquids includes a foaming agent, enhances foaming by creating air bubbles before or during impact with the inner walls of the chamber and/or upon passing through mesh screen 28.

In operation, with the mixing manifold attachment 16 mounted against front face 34 in FIG. 1, and as shown in FIG. 6 for the FIG. 2 variant, and assuming the dual pump to be primed, each pull of the trigger lever (not shown) pressurizes the liquids in their respective side-by-side pumping units and simultaneously discharges the disparate liquids separately through their respective discharge barrels 11 and 12 whereupon they pass through their spin mechanics assemblies (not shown) within nozzle cap 15 for particle breakup in the normal manner of the two liquids while separated for issuance through their respective discharge orifices 13 and 14 as conical spray plumes of first and second disparate liquids. The spray particles enter mixing manifold 17 where the sprays are intimately mixed together during the turbulent flow pattern created within the mixing chamber which provides an impact obstruction to knock down the fines at the outer edges of the sprays moving at highest velocity on entering the chamber to thereby focus them into the primary mix. The spray particles of the two liquids impact against the five inner walls of the attachment colliding with one another as induced by the inner contoured walls of the chamber. Swirl vanes 25 may be provided to enhance the intimate intermingling of the two sprays prior to discharge through nozzle 27 and/or to effect further turbulence. Swirl vanes 29 may be provided on the inner wall of the nozzle 27 to enhance the swirling velocity and the force at which the combined spray exits the nozzle and/or to even further enhance turbulence. Foaming of the admixed sprays, assuming one or both the sprays containing a foaming agent, can be enhanced by the provision of mesh screen 28 through which the admixture passes and collides with the strands of the mesh to effect a fine particle breakup and produce foam.

Figure 5:
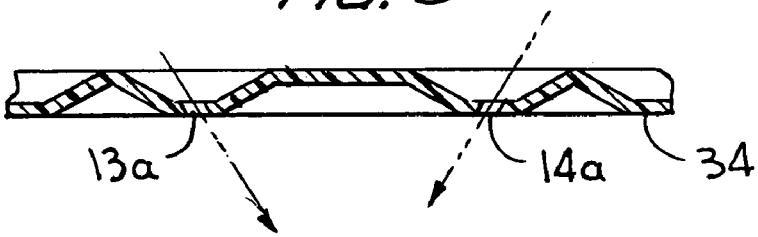
FIG. 5 is a sectional view taken substantially along the line 5—5 of FIG. 2.

Other measures can be taken to ensure an even more intimate mixing of the two sprays within the mixing chamber. For example, as shown in FIG. 5, discharge orifices 13*a* and 14*a*, respectively associated with discharge barrels 11 and 12, can be oriented in front face 34 of nozzle cap 15 so as to be angled toward one another as shown by the arrows in FIG. 5 so that upon exiting these orifices the sprays directly collide with one another within the mixing manifold as well as with the inner walls of the manifold to effect intimate commingling of the spray particles prior to discharge.

Figure 7:
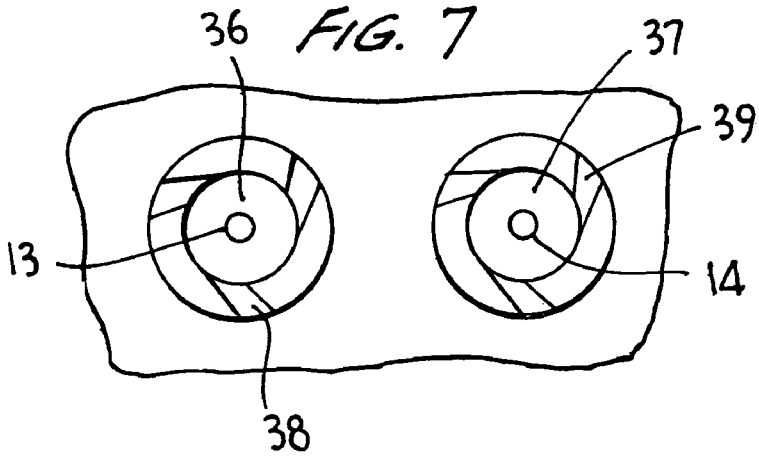
FIG. 7 is a view of spray mechanics assemblies in accordance with one embodiment employed for the invention.

And, as shown in FIG. 7, the spin mechanics for each of the spray nozzles of nozzle cap are of known construction as, for example, a swirl chamber 36 and 37 associated with orifices 13 and 14 into which liquid is channeled via tangentials 38 and 39, respectively, thus inducing swirls of the liquids entering the swirl chambers which issue through orifices 13 and 14 in the form of conical sprays. Optionally, tangentials 38 and 39 can be disposed to effect swirling in opposite directions to enhance the mixing of the liquids in mixing chamber 12.

External mixing chamber 17 according to the invention functions to contour and/or incorporate the outer fine particles from each spray into the mix. Without the mixing chamber, the outer fines of each spray become airborne before they can possibly be entrained into the center. This is because the highest velocity is at the outer edge of the spray cone. The mixing chamber according to the invention provides an impact obstruction to knock them down and focus them into the primary mix. In accordance with the invention, disparate fluids are spray atomized from separate discrete swirl chambers and orifices whereafter they are force commingled in an atomized state within an external mixing manifold located downstream of the discrete swirl chambers and sprayer discharge orifices. The external mixing chamber may be of a predetermined geometry to control the degree of mixing depending on the specific spray liquids. The external mixing chamber of the invention is intended to admix separate atomized liquids prior to their hitting the target.

Obviously, many modifications and variations of the present invention are made possible in the light of the above teachings. For example, rather than legs on attachment 16 which provide gaps therebetween when mounted to nozzle 15, one or both of the attachment and the nozzle cap could be provided with notches 30 (FIG. 1) to define air aspiration openings. And, the external mixing chamber 17 can include some type of baffled geometry such as ribs, vanes, bumps, grooves, a rough surface finish, etc., to enhance turbulence in mixing chamber 17 and therefore provide for a more intimate combining of the two liquids before issuing through nozzle 27. The foaming consistency can be varied by varying the size of the air aspiration openings, and screens other than mesh screens could be provided for foaming. It is therefore to be understood that within the scope of the appended claims, the invention may be practiced otherwise than as specifically described.

What is claimed is:

1. A trigger operated fluid sprayer for simultaneously dispensing first and second liquids stored in respective first and second liquid compartments, comprising:

a dispenser housing having pump means including a pair of side-by-side pump pistons respectively reciprocable in a pair of side-by-side pump cylinders configured so that reciprocation of the pump pistons draws the liquids from the liquid compartments into the pump chambers and discharges the liquids through separate discharge passages;

discharge nozzle means defining a pair of spin mechanics assemblies and corresponding discharge orifices respectively associated with said discharge passages, wherein liquids issue from said discharge orifices as separate sprays; and an external mixing manifold mounted to and downstream of said discharge nozzle means for combining the sprays issuing from the discharge orifices for discharge through a single discharge port.

2. The sprayer according to claim 1, wherein the discharge nozzle means comprises at least one nozzle cap mounted on said housing at a terminate end of said discharge passages, said nozzle cap including said spin mechanics assemblies, and said mixing manifold comprising an attachment mounted on said nozzle cap.

3. The sprayer according to claim 2, wherein said attachment defines at least one air aspiration opening to effect foaming of the combined liquids issuing through the discharge port.

4. The sprayer according to claim 1, wherein said external mixing manifold comprises an attachment having a smooth walled mixing chamber in open communication with said discharge orifices for generating foam as the liquids impact thereagainst to mix with air ingested through at least one air aspiration opening of said mixing manifold.

5. The sprayer according to claim 1, wherein said mixing manifold comprises an attachment having a smooth walled mixing chamber in open communication with said discharge orifices.

6. The sprayer according to claim 1, wherein said mixing manifold comprises an attachment having a non-smooth walled chamber in open communication with said discharge orifices for enhancing turbulence as the liquids impact thereagainst providing for intimate combining of the liquids before issuing from the discharge port.

7. The sprayer according to claim 1, wherein said mixing manifold includes a foamer at the discharge port to aid in foaming the mixed liquids prior to discharge through the discharge port.

8. The sprayer according to claim 1, wherein the discharge nozzle means comprises at least one nozzle cap mounted on said housing at a terminal end of said discharge passages, said nozzle cap comprising said spin mechanics assemblies.

9. The sprayer according to claim 1, wherein central axes of said discharge orifices intersect within said mixing manifold to enhance the combining of the liquids.

10. The sprayer according to claim 1, wherein:

at least one of said separate discharge passages has a long axis, and said mixing manifold is disposed along said long axis relative to said separate discharge passages.

11. An assembly for use in a trigger operated fluid sprayer for simultaneously dispensing first and second liquids stored in respective first and second liquid compartments, the assembly comprising:

a pump body;

at least one nozzle cap mounted on said pump body at a forward end thereof; and a closure on said pump body for mounting the assembly to at least one liquid container having said compartments:

said pump body having two separate discharge passages, at least one of said two discharge passages having a long axis, and said pump body having pump means including a pair of side-by-side pump pistons respectively reciprocable in a pair of side-by-side pump cylinders configured so that reciprocation of the pump pistons draws the liquids from the compartments into the pump chambers and discharges the liquids through said two separate discharge passages; and wherein the nozzle cap includes a pair of spin mechanics assemblies with two discharge orifices associated with said two discharge passages, wherein the liquids issue from said two discharge orifices as separate sprays in a direction having a component parallel to said long axis;

an external attachment mounted on said nozzle cap, the attachment defining a mixing manifold in open communication with the two discharge orifices for combining the sprays issuing from the assembly through said two discharges orifices in said direction and for discharging the combined sprays through a discharge port in the attachment.

12. The assembly according to claim 11, wherein said mixing manifold comprises a smooth-walled chamber arranged such that the sprays impact against walls of the chamber and intimately intermingle before issuing through the discharge port.

13. The assembly according to claim 11, wherein the attachment defines at least one air aspiration opening to effect foaming of the combined sprays issuing from the discharge port.

14. The assembly according to claim 11, wherein said mixing manifold comprises a non-smooth walled chamber to enhance intermingling of spray particles as the sprays impact against walls of the chamber.

15. The assembly according to claim 11, wherein the external attachment includes a foamer screen at the discharge port thereof to effect foaming of combined sprays upon discharge.

16. The assembly according to claim 11, wherein the two discharge orifices are oriented relative to each other such that central axes thereof intersect within said mixing manifold to effect intermingling of the separate sprays issuing from the two discharge orifices.

17. The assembly according to claim 11, wherein the attachment has an external nozzle surrounding the discharge port.

18. The assembly according to claim 17, wherein swirl means are provided internally of the nozzle cap to enhance spraying of the combined sprays from the discharge port.

* * * * *